US005379854A

United States Patent [19]

Dennis

[11] Patent Number: 5,379,854

[45] Date of Patent: Jan. 10, 1995

[54] CUTTING ELEMENT FOR DRILL BITS

[75] Inventor: Thomas M. Dennis, Houston, Tex.

[73] Assignee: Dennis Tool Company, Houston, Tex.

[21] Appl. No.: 108,071

[22] Filed: Aug. 17, 1993

[51] Int. Cl.[6] ..... E21B 10/56

[52] U.S. Cl. ..... 175/434; 175/426; 51/307; 76/108.2; 408/145

[58] Field of Search ..... 175/434, 426, 432, 374; 51/295, 309, 293; 76/108.6, 108.2; 407/118, 119; 408/144, 145

[56] References Cited

U.S. PATENT DOCUMENTS

| | | | |
|---|---|---|---|
| 4,109,737 | 8/1978 | Bovenkerk | 175/434 |
| 4,255,165 | 3/1981 | Dennis | 51/295 |
| 4,592,433 | 6/1986 | Dennis | 175/434 |
| 4,629,373 | 12/1986 | Hall | 407/118 |
| 4,784,023 | 11/1988 | Dennis | 76/108 A |
| 5,007,207 | 4/1991 | Phaal | 175/322 X |
| 5,011,515 | 4/1991 | Frushour | 51/307 |

*Primary Examiner*—Stephen J. Novosad
*Attorney, Agent, or Firm*—Gunn & Kuffner

[57] ABSTRACT

A cutting element which has a metal carbide stud having a plurality of ridges formed in a reduced or full diameter hemispherical outer end portion of said metal carbide stud. The ridges extend outwardly beyond the outer end portion of the metal carbide stud. A layer of polycrystalline material, resistant to corrosive and abrasive materials, is disposed over the ridges and the outer end portion of the metal carbide stud to form a hemispherical cap.

21 Claims, 3 Drawing Sheets

FIG.9
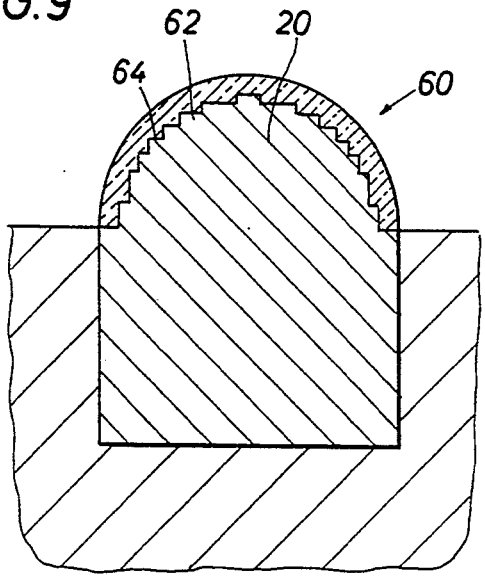
FIG.10
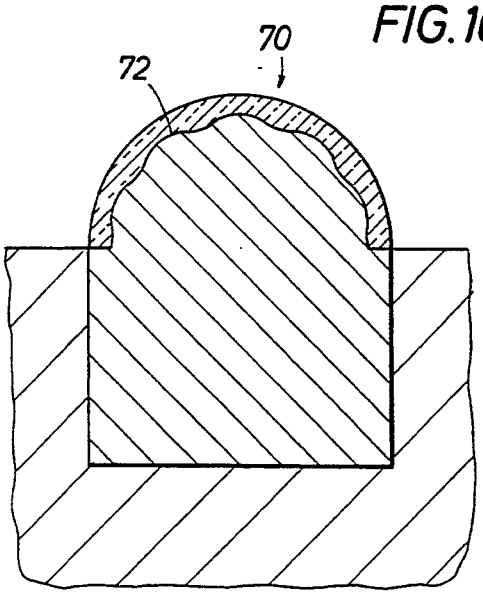
FIG.11
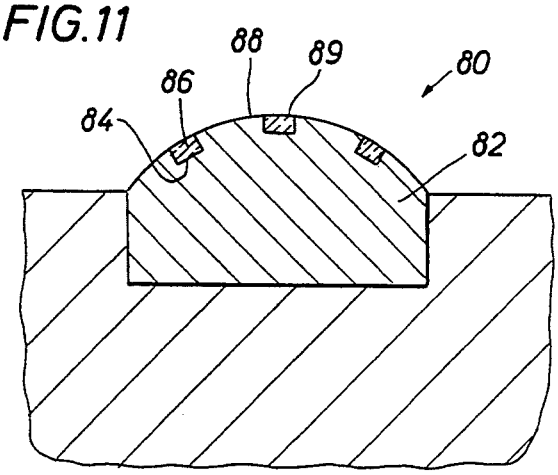
FIG.12
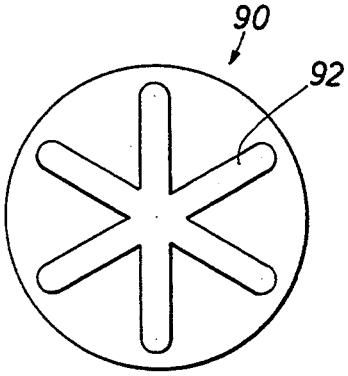
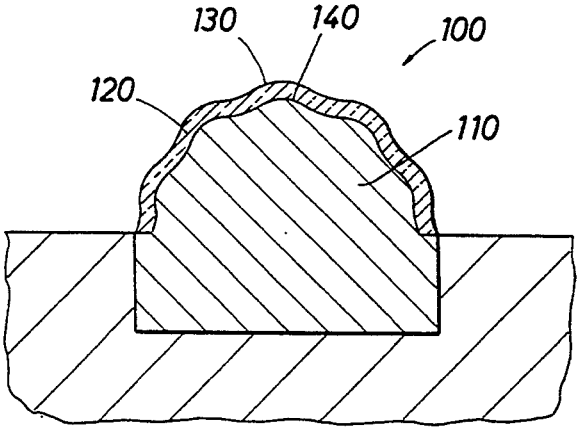
FIG.13

CUTTING ELEMENT FOR DRILL BITS

BACKGROUND OF THE INVENTION

The present invention relates to the fabrication of cutting elements for use in rock drilling, machining of wear resistant metals, and other operations which require the high abrasion resistance or wear resistance of a diamond surface. Specifically, this invention relates to such bodies which comprise a polycrystalline diamond layer attached to a cemented metal carbide stud through processing at ultrahigh pressures and temperatures.

In the following disclosure and claims, it should be understood that the term polycrystalline diamond, PCD, or sintered diamond, as the material is often referred to in the literature, can also be any of the superhard abrasive materials, including, but not limited to synthetic or natural diamond, cubic boron nitride, and wurtzite boron nitride as well as combinations thereof. Also, cemented metal carbide refers to a carbide of one of the group IVB, VB, or VIB metals which is pressed and sintered in the presence of a binder of cobalt, nickel, or iron and the alloys thereof.

This application is related to composite or adherent multimaterial bodies of diamond, cubic boron nitride (CBN) or wurtzite boron nitride (WBN) or mixtures thereof for use as a shaping, extruding, cutting, abrading or abrasion resistant material and particularly as a cutting element for rock drilling.

As discussed in U.S. Pat. No. 4,255,165, a cluster compact is defined as a cluster of abrasive particles bonded together either (1) in a self-bonded relationship, (2) by means of a bonding medium disposed between the crystals, or (3) by means of some combination of (1) and (2). Reference is made to U.S. Pat. Nos. 3,136,615, 3,233,988 and 3,609,818 for a detailed disclosure of certain types of compacts and methods for making such compacts. (The disclosures of these patents are hereby incorporated by reference herein.)

A composite compact is defined as a cluster compact bonded to a substrate material such as cemented tungsten carbide. A bond to the substrate can be formed either during or subsequent to the formation of the cluster compact. It is, however, highly preferable to form the bond at high temperatures and high pressures comparable to those at which the cluster compact is formed. Reference can be made to U.S. Pat. Nos. 3,743,489, 3,745,623 and 3,767,371 for a detailed disclosure of certain types of composite compacts and methods for making same. (The disclosures of these patents are hereby incorporated by reference herein.)

As discussed in U.S. Pat. No. 5,011,515, composite polycrystalline diamond compacts, PCD, have been used for industrial applications including rock drilling and metal machining for many years. One of the factors limiting the success of PCD is the strength of the bond between the polycrystalline diamond layer and the sintered metal carbide substrate. For example, analyses of the failure mode for drill bits used for deep hole rock drilling show that in approximately 33 percent of the cases, bit failure or wear is caused by delamination of the diamond from the metal carbide substrate.

U.S. Pat. No. 3,745,623 (reissue U.S. Pat. No. Re. 32,380) teaches the attachment of diamond to tungsten carbide support material with an abrupt transition therebetween. This, however, results in a cutting tool with a relatively low impact resistance. Due to the differences in the thermal expansion of diamond in the PCD layer and the binder metal used to cement the metal carbide substrate, there exists a shear stress in excess of 200,000 psi between these two layers. The force exerted by this stress must be overcome by the extremely thin layer of cobalt which is the common or preferred binding medium that holds the PCD layer to the metal carbide substrate. Because of the very high stress between the two layers which have a fiat and relatively narrow transition zone, it is relatively easy for the compact to delaminate in this area upon impact. Additionally, it has been known that delamination can also occur on heating or other disturbances in addition to impact. In fact, parts have delaminated without any known provocation, most probably as a result of a defect within the interface or body of the PCD which initiates a crack and results in catastrophic failure.

One solution to this problem is proposed in the teaching of U.S. Pat. No. 4,604,106. This patent utilizes one or more transitional layers incorporating powdered mixtures with various percentages of diamond, tungsten carbide, and cobalt to distribute the stress caused by the difference in thermal expansion over a larger area. A problem with this solution is that "sweep-through" of the metallic catalyst sintering agent is impeded by the free cobalt and the cobalt cemented carbide in the mixture.

U.S. Pat. No. 4,784,023 teaches the grooving of polycrystalline diamond substrates but it does not teach the use of patterned substrates designed to uniformly reduce the stress between the polycrystalline diamond layer and the substrate support layer. In fact, this patent specifically mentions the use of undercut (or dovetail) portions of substrate ridges, which solution actually contributes to increased localized stress. Instead of reducing the stress between the polycrystalline diamond layer and the metallic substrate, this actually makes the situation much worse. This is because the larger volume of metal at the top of the ridge will expand and contract during heating cycles to a greater extent than the polycrystalline diamond, forcing the composite to fracture at the interface. As a result, construction of a polycrystalline diamond cutter following the teachings provided by U.S. Pat. No. 4,784,023 is not suitable for cutting applications where repeated high impact forces are encountered, such as in percussive drilling, nor in applications where extreme thermal shock is a consideration.

U.S. Pat. No. 4,592,433 teaches grooving substrates but it does not have a solid diamond table across the entire top surface of the substrate. While this configuration is not subject to delamination, it cannot compete in harsh abrasive applications.

U.S. Pat. No. 5,011,515 teaches the use of a sintered metal carbide substrate with surface irregularities spread relatively uniformly across its surface. The three-dimensional irregularities can be patterned or random to control the percentage of diamond in the zone that exists between the metal carbide support and the polycrystalline diamond layer. This zone can be of varying thickness.

U.S. Pat. No. 4,109,737 teaches the use of a pin with a reduced diameter hemispherical projection over which a diamond layer is directly bonded in the form of a hemispherical cap. The polycrystalline diamond layer receives greater support from the hemispherical shape to make the surface more resistant to impact.

SUMMARY OF THE INVENTION

A cutting element for use in drill bits for rock drilling, machining of wear resistant metals, and other operations which require the high abrasion resistance or wear resistance of a diamond surface, comprises a cemented metal carbide stud, preferably tungsten carbide, having a reduced diameter hemispherical outer end surface with a plurality of ridges formed therein. Other forms of cutting elements are shown. A layer of polycrystalline material is disposed over the outer end portion of the cemented metal carbide stud to form a hemispherical cap.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 9 is a cross-sectional view of a cutting element in a drill bit where the ridges in the metal carbide stud are tapered;

FIG. 10 is a cross-sectional view of a cutting element in a drill bit where the ridges are semicircular;

FIG. 11 is a cross-sectional view of a cutting element in a drill bit where the metal carbide stud has grooves cut into the top surface which are filled flush with polycrystalline material;

FIG. 12 is a top view of the tungsten carbide stud having radially positioned grooves filled flush with the layer of polycrystalline material; and FIG. 13 is a cross-sectional view of a cutting element in a drill bit where a uniform thickness of polycrystalline material is applied to the metal carbide stud so that the polycrystalline layer takes on a similar profile to that of the metal carbid stud.

DETAILED DESCRIPTION OF THE PREFERRED EMBODIMENT

Figure 1:
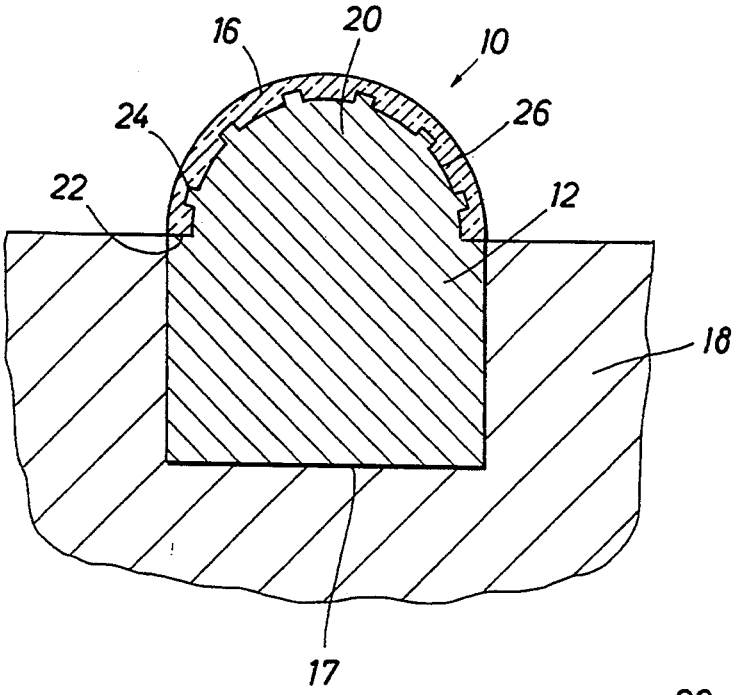
FIG. 1 is a cross-sectional view of a cutting element in a drill bit where the top portion of the metal carbide stud is a reduced hemisphere.

A cutting element 10 according to the present invention comprises a metal carbide stud 12 and a layer of polycrystalline material 16. The metal carbide stud 12 is wedged tightly into a machined recess 17 in a drill bit wall 18. In the embodiment of FIG. 1, the metal carbide stud 12 has a reduced diameter hemispherical projection 20 and shoulder 22 which is uniform around the circumference of the cylindrical stud 12. The metal carbide stud 12 has a plurality of ridges 24 formed in the top portion of the hemispherical projection 20. The ridges 24 extend outwardly beyond the surface 26 of the hemispherical projection 20. The polycrystalline material 16 is disposed over the surface 26 to define a hemispherical cap. The layer of polycrystalline material 16 is generally sufficient of thickness to cover the shoulder 22 of the metal carbide stud 12. In this manner, the polycrystalline material 16 shields and protects the metal carbide stud 12 from corrosive and abrasive elements encountered in drilling operations.

Figure 2:
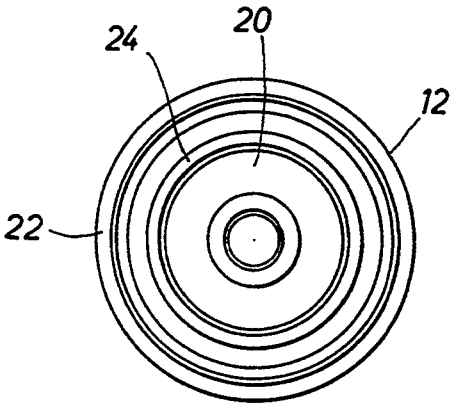
FIG. 2 is a top view of the metal carbide stud with the layer of polycrystalline material removed to show a concentric pattern of ridges and a shoulder.

FIG. 2 is a top view of the metal carbide stud 12 with the layer of polycrystalline material 16 removed to show a concentric pattern of ridges 24 and the shoulder 22. It should be apparent that the ridges may be replaced with grooves without departing from the scope of the invention.

Figure 3:
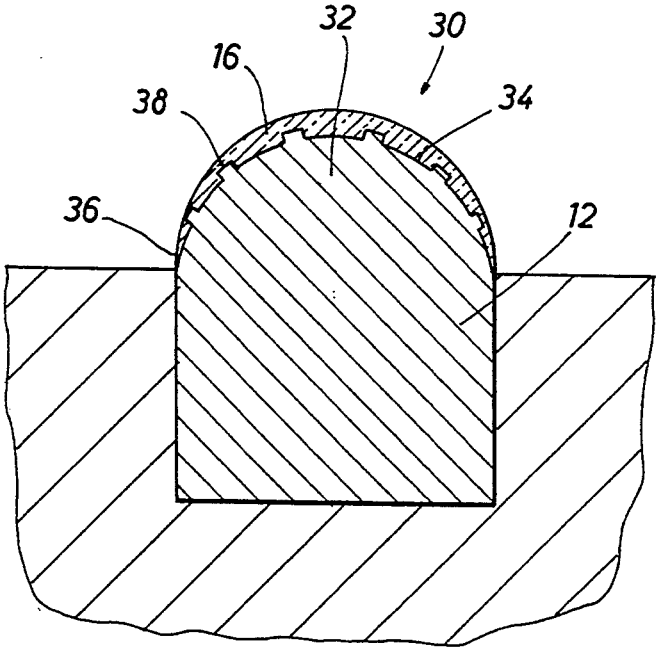
FIG. 3 is a cross-sectional view of an alternate embodiment of a cutting element in a drill bit where the top portion of the tungsten carbide stud is a full hemisphere.

FIG. 3 illustrates an alternate embodiment of the present invention, shown as cutting element 30, where metal carbide stud 12 has a full diameter hemispherical projection 32. The layer of polycrystalline material 16 is disposed over the surface 34 and ridges 38. The thickness of the layer of polycrystalline material 16 tapers around its perimeter near the marginal perimeter 36.

Figure 4:
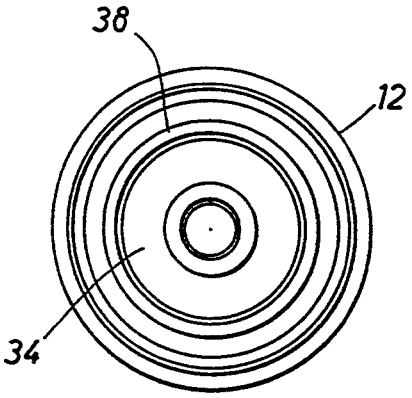
FIG. 4 is a top view of the tungsten carbide stud with the layer of polycrystalline material removed to show a concentric pattern of ridges.

FIG. 4 is a top view of the metal carbide stud 12 with the layer of polycrystalline material 16 removed to show a concentric pattern of ridges 38.

Figure 5:
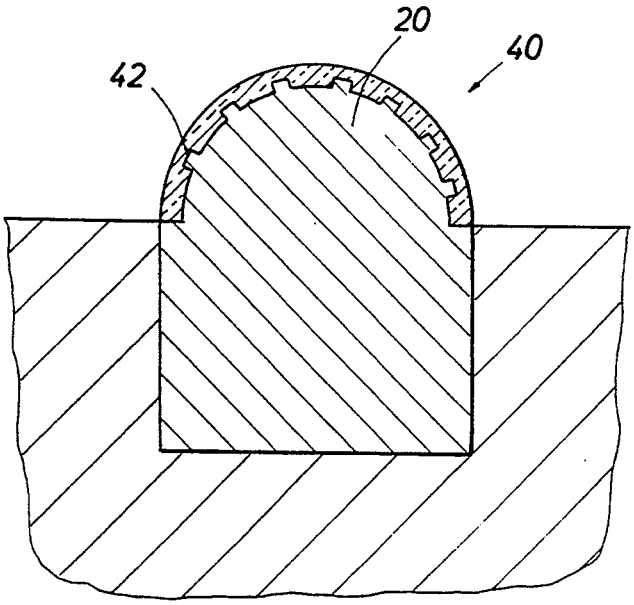
FIG. 5 is a cross-sectional view of another alternate embodiment of a cutting element in a drill bit where the ridges collectively define a single spiral ridge.
Figure 6:
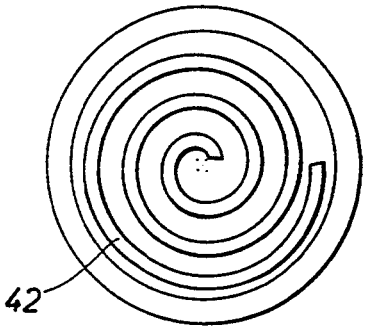
FIG. 6 is a top view of the tungsten carbide stud with the layer of polycrystalline material removed to show ridge lines collectively defining a single spiral ridge.

FIG. 5 shows an embodiment of the cutting element 40 with a single spiraling ridge 42. The spiraling ridge 42 is most clearly illustrated in FIG. 6 which is a plan view of the metal carbide stud 12 with the layer of polycrystalline material 16 removed. Note that a spiraling ridge such as the spiraling ridge 42 is often used in combination with a full diameter hemispherical projection, such as the projection 32 in FIG. 3, as well as a reduced diameter hemispherical projection 20.

Figure 7:
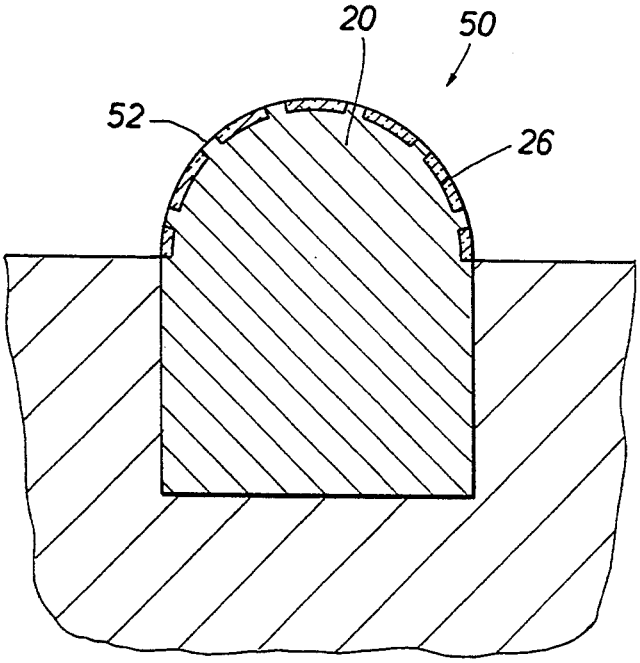
FIG. 7 is a cross-sectional view of yet another alternate embodiment of a cutting element in a drill bit where the polycrystalline material is applied to a thickness equal to the height of the ridges in the tungsten carbide stud so that the studs are partially exposed.
Figure 8:
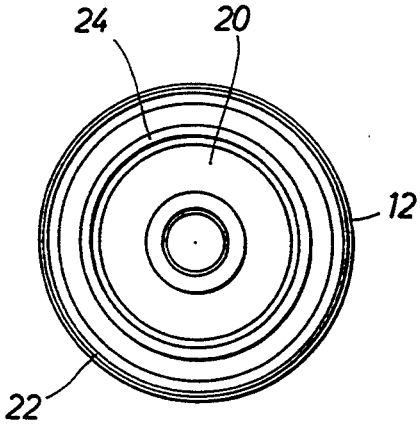
FIG. 8 is a top view of the tungsten carbide stud with the layer of polycrystalline material removed to show a concentric pattern of ridges and a shoulder.

The cutting element 50 in FIG. 7 is yet another embodiment in which the polycrystalline layer 16 has a thickness equal to the height of the ridges 52 extending outwardly beyond the surface 26 of projection 20. FIG. 8 is similar to FIG. 2 and shows a top view of the metal carbide stud 12 with the layer of polycrystalline material 16 removed to show a concentric pattern of ridges 24 and the shoulder 22.

FIG. 9 shows the cutting element 60 having a plurality of ridges 62 in the projection 20 having the form of steps. The ridges 62 may be concentric circular ridges or collectively define a single spiraling ridge or step. The top portion face of the ridge 62 may take any appropriate shape, such as pointed ridges or irregular ridges, however it is illustrated here as a step. FIG. 10 is a similar embodiment of a cutting element 70 having surface 72 where the ridge is a sinusoidal curve. The elements are easier to machine in the preliminary steps of fabrication.

FIG. 11 shows a cutting element 80 having a carbide metal stud 82 having a plurality of grooves 84 filled flush with polycrystalline material 86 so that the metal carbide surface 88 and the polycrystalline surface 89 are both exposed at a common face to define a smooth transition. The polycrystalline-filled grooves may take on a number of various configurations, including parallel, spiral, concentric, irregular and radial. The preferred configuration of grooves is shown in FIG. 12 as a metal carbide stud 90 having a plurality of radially extending polycrystalline-filled grooves 92.

FIG. 13 shows a cutting element 100 with a metal carbide stud having a reduced diameter hemispherical projection 110. The stud surface is shown with a sinusoidal cross section and a uniform thickness of the polycrystalline material 120. Applying a uniform layer of polycrystalline material, the top surface takes on a similar contour or profile 130 as that of the metal carbide stud surface 140.

A first significant advantage of the embodiments described above is that the hemispherical projection, such as the projection 20 in FIG. 1, reduces the amount of shear stress applied to the polycrystalline layer 16. As a matter of geometry, the hemispherical shape of the projection will tend to experience forces which are normal to the surface of the polycrystalline surface rather than forces which shear across its face. Without the hemispherical protrusion, the planar layer interface between the joined materials will often be subjected to shear forces tending to break off the outer tip. The break line is at the interface between the joined dissimilar materials. For example, as a drill bit rotates about its axis, the hemispherical projection 20 must contact against the working face of the drilled hole with a shattering impact of substantial shock. The apex or outermost portion of the cutting element will continue to experience shearing forces during drilling. In this invention, the hemispherical projection helps to prevent delamination of the polycrystalline layer from the metal carbide stud.

A second advantage arises from the stepwise transition of materials which reduces the amount of shear stress on the bond between the layer of polycrystalline material and the metal carbide stud. When the polycrystalline layer is bonded face to face with the smooth surface of a metal carbide stud, the overall strength of the cutting element is dependent primarily by the strength of the bond. However, the bond is ordinarily much weaker in the dimension and will withstand less shear stress than either the polycrystalline layer or the metal carbide stud. Therefore, the present invention includes a plurality of ridges or grooves which serve as a structural reinforcement between the metal carbide stud and the polycrystalline layer. The ridges function in a manner to transfer shear stresses from the polycrystalline layer to the metal carbide stud without placing the full amount of the stress on the bond. As a result, the cutting element can withstand shear forces which are significantly greater than that which the bonding material alone can sustain.

A third advantage of the protruding hemispheric member is the improved resistance to delamination caused by differences in the degree of thermal expansion between the polycrystalline layer and the metal carbide stud. Under high temperatures, the metal carbide stud must expand to a greater degree than the layer of polycrystalline material and creates thermally induced tension across the entire bonding region. Ordinarily, face to face bonding of the polycrystalline layer to the metal carbide stud exposes the entire face area of the bond therebetween to stress and is therefore subject to delamination as a result of thermally induced stress alone. To avoid this problem, the ridges redistribute the stress when heating occurs. In this manner, a relatively reduced stress gradient during thermal expansion is obtained and extends from the outer surface of the polycrystalline layer down to the thickest portion of the metal carbide stud. Having distributed the stress across greater a distance, the stresses caused by differences in thermal expansion are significantly lower than that placed on the thin, face to face bond.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiments, the scope thereof is determined by the claims which follow:

I claim:

1. A cutting element, comprising:

(a) a metal carbide stud having an outer hemispherical end portion;

(b) a plurality of ridges formed on said outer end portion, wherein each of said ridges has a substantially planar top surface extending outwardly from the outer end portion of said metal carbide stud; and (c) a layer of polycrystalline material disposed over the ridges and the outer end portion of said metal carbide stud, said polycrystalline material comprising abrasive particles selected from diamond, cubic boron nitride, wurtzite boron nitride, and mixtures thereof, bonded together in a unitary relationship.

2. The cutting element of claim 1 wherein said metal carbide stud is cylindrical.

3. The cutting element of claim 2 wherein said outer end portion of said metal carbide stud has a reduced diameter hemispherical projection.

4. The cutting element of claim 3 wherein said plurality of ridges are concentric.

5. The cutting element of claim 3 wherein said plurality of ridges collectively define a spiraling ridge.

6. The cutting element of claim 3 wherein said plurality of ridges define a checkerboard pattern.

7. The cutting element of claim 3 wherein said metal carbide includes tungsten carbide particles.

8. The cutting element of claim 1 wherein said plural ridges extend from said outer end portion of said stud to define an area between said ridges, said area being a portion of said hemispherical end portion so that said riges and end portion define a bonded interface with said layer disposed over said ridges and said interface secures said layer to said stud.

9. A cutting element, comprising:

(a) a cylindrical metal carbide stud having an outer hemispherical end portion, said metal carbide stud including tungsten carbide particles;

(b) a plurality of ridges formed in said outer end portion, wherein each of said ridges has a substantially planar top surface extending outwardly from the outer end portion of said metal carbide stud; and (c) a layer of polycrystalline diamond disposed over the ridges and the outer end portion of said metal carbide stud, bonded together in a unitary relationship.

10. The cutting element of claim 9 wherein said plurality of ridges are stepped.

11. The cutting element of claim 9 wherein said layer of polycrystalline material has a uniform thickness over the ridges of said outer end portion.

12. The cutting element of claim 9 wherein said outer end portion of said metal carbide stud has a reduced diameter hemispherical projection.

13. The cutting element of claim 12 wherein said plurality of ridges are concentric.

14. The cutting element of claim 12 wherein said plurality of ridges collectively define a spiraling ridge.

15. A cutting element, comprising:

(a) a cylindrical metal carbide stud having an outer hemispherical end portion, said metal carbide including tungsten carbide particles;

(b) a plurality of ridges formed in said outer end portion, wherein each of said ridges has a substantially planar top surface extending outwardly from said outer end portion of said metal carbide stud; and (c) a layer of polycrystalline material disposed over the outer end portion of said metal carbide stud, wherein said polycrystalline material is bonded together in a unitary relationship, wherein said layer of polycrystalline material is applied between said ridges to a thickness equal to or exceeding the height of said ridges, and wherein the top surface of said ridges is at least partially exposed.

16. The cutting element of claim 15 wherein said plurality of ridges are concentric.

17. The cutting element of claim 15 wherein said plurality of ridges collectively define a single spiraling ridge.

18. The cutting element of claim 15 wherein said plurality of ridges are stepped.

19. The cutting element of claim 15 wherein said stud is positioned and secured in a drill bit body.

20. The cutting element of claim 19 wherein said drill bit body anchors a set of said studs to define a drill bit body for drilling.

21. The cutting element of claim 15 wherein said plural ridges extend from said outer end portion of said stud to define an area between said ridges, said area being a portion of said hemispherical end portion so that said riges and end portion define a bonded interface with said layer disposed over said ridges and said interface secures said layer to said stud.

* * * * *